United States Patent [19]

Chujo et al.

[11] Patent Number: 4,703,619

[45] Date of Patent: Nov. 3, 1987

[54] DOUBLE AIR-FUEL RATIO SENSOR SYSTEM HAVING IMPROVED RESPONSE CHARACTERISTICS

[75] Inventors: Yoshiki Chujo, Mishima; Nobuaki Kayanuma, Gotenba; Hironori Bessho, Susono; Takatoshi Masui, Mishima; Toshiyasu Katsuno; Toshio Tanahashi, both of Susono, all of Japan

[73] Assignee: Toyota Jidosha Kabushiki Kaisha, Aichi, Japan

[21] Appl. No.: 848,263

[22] Filed: Apr. 4, 1986

[30] Foreign Application Priority Data

Apr. 9, 1985 [JP] Japan ..... 60-073554

[51] Int. Cl.[4] ..... F02D 41/02

[52] U.S. Cl. ..... 60/274; 60/276; 60/285; 123/489

[58] Field of Search ..... 123/440, 489, 589; 60/276, 285, 274; 364/431.05

[56] References Cited

U.S. PATENT DOCUMENTS

| | | | |
|---|---|---|---|
| 3,939,654 | 2/1976 | Creps | 60/276 |
| 4,027,477 | 6/1977 | Storey | 60/276 |
| 4,130,095 | 12/1978 | Bowler et al. | 123/440 |
| 4,235,204 | 11/1980 | Rice | 123/440 |
| 4,475,517 | 10/1984 | Kobayashi et al. | 123/489 |
| 4,539,958 | 9/1985 | Ito et al. | 123/440 |
| 4,561,400 | 12/1985 | Hattori | 123/478 |
| 4,571,683 | 2/1986 | Kobayashi et al. | 364/431.05 |

FOREIGN PATENT DOCUMENTS

| | | |
|---|---|---|
| 52-102934 | 8/1977 | Japan . |
| 53-103796 | 9/1978 | Japan . |
| 55-37562 | 3/1980 | Japan . |
| 57-32772 | 7/1982 | Japan . |
| 57-32773 | 7/1982 | Japan . |
| 57-32774 | 7/1982 | Japan . |
| 58-27848 | 2/1983 | Japan . |
| 58-53661 | 3/1983 | Japan . |
| 58-48755 | 3/1983 | Japan . |
| 58-48756 | 3/1983 | Japan . |
| 58-72646 | 4/1983 | Japan . |
| 58-72647 | 4/1983 | Japan . |
| 58-135343 | 8/1983 | Japan . |
| 58-152147 | 9/1983 | Japan . |
| 58-150038 | 9/1983 | Japan . |
| 58-150039 | 9/1983 | Japan . |
| 59-32644 | 2/1984 | Japan . |
| 59-206638 | 11/1984 | Japan . |
| 60-1340 | 1/1985 | Japan . |
| 60-26138 | 2/1985 | Japan . |
| 60-53635 | 3/1985 | Japan . |
| 61-34330 | 2/1986 | Japan . |
| 61-53436 | 3/1986 | Japan . |

*Primary Examiner*—Andrew M. Dolinar

*Attorney, Agent, or Firm*—Parkhurst & Oliff

[57] ABSTRACT

In a double air-fuel sensor system including two air-fuel ratio sensors upstream and downstream of a catalyst converter provided in an exhaust gas passage, an air-fuel ratio correction amount is gradually changed in accordance with the output of the upstream-side air-fuel ratio sensor, and the actual air-fuel ratio is adjusted in accordance with the air-fuel ratio correction amount. The gradual-change speed of the air-fuel ratio correction amount is changed in accordance with the output of the downstream-side air-fuel ratio sensor.

14 Claims, 29 Drawing Figures

| Fig.4A | Fig.4B | Fig.4C |
|---|---|---|

LEAN
RICH
A/F

TDR1
CDLY1
0
t1
t2
t3
t4
t5
t6
t7
t8
TDL1

TDR1
LEAN
RICH
TDL1
F1
TDR1

RSL
KIR
FAF
RSR
KIL

| Fig.6A | Fig.6B |
|---|---|

| Fig. 7A | Fig. 7B |
|---|---|

V
V1
VR1
0

RICH
LEAN
TDR1
TDL1

RICH
LEAN

KIR
KIL
RSR
RSL
FAF'
FAF

V
V2
VR2
0

LEAN
RICH
TDL2
TDR2

LEAN
RICH

KIR
ΔKI'
ΔKI
ΔKI'

KIL

DOUBLE AIR-FUEL RATIO SENSOR SYSTEM HAVING IMPROVED RESPONSE CHARACTERISTICS

BACKGROUND OF THE INVENTION

1. Field of the Invention

The present invention relates to a method and apparatus for feedback control of an air-fuel ratio in an internal combustion engine having two air-fuel ratio, sensors upstream and downstream of a catalyst converter disposed within an exhaust gas passage.

2. Description of the Related Art

Generally, in a feedback control of the air-fuel ratio in a single air-fuel ratio sensor ($O_2$ sensor) system, a base fuel amount TAUP is calculated in accordance with the detected intake air amount and detected engine speed, and the base fuel amount TAUP is corrected by an air-fuel ratio correction coefficient FAF which is calculated in accordance with the output signal of an air-fuel ratio sensor (for example, an $O_2$ sensor) for detecting the concentration of a specific component such as the oxygen component in the exhaust gas. Thus, an actual fuel amount is controlled in accordance with the corrected fuel amount. The above-mentioned process is repeated so that the air-fuel ratio of the engine is brought close to a stoichiometric air-fuel ratio. According to this feedback control, the center of the controlled air-fuel ratio can be within a very small range of air-fuel ratios around the stoichiometric ratio required for three-way reducing and oxidizing catalysts (catalyst converter) which can remove three pollutants CO, HC, and $NO_x$ simultaneously from the exhaust gas.

In the above-mentioned $O_2$ sensor system where the $O_2$ sensor is disposed at a location near the concentration portion of an exhaust manifold, i.e., upstream of the catalyst converter, the accuracy of the controlled air-fuel ratio is affected by individual differences in the characteristics of the parts of the engine, such as the $O_2$ sensor, the fuel injection valves, the exhaust gas recirculation (EGR) valve, the valve lifters, individual changes due to the aging of these parts, environmental changes, and the like. That is, if the characteristics of the $O_2$ sensor fluctuate, or if the uniformity of the exhaust gas fluctuates, the accuracy of the air-fuel ratio correction amount FAF is also fluctuated, thereby causing fluctuations in the controlled air-fuel ratio.

To compensate for the fluctuation of the controlled air-fuel ratio, double $O_2$ sensor systems have been suggested (see: Japanese Unexamined Patent Publication (Kokai) Nos. 55-37562, 58-48755, and 58-72647). In such a double $O_2$ sensor system, another $O_2$ sensor is provided downstream of the catalyst converter, and thus another air-fuel ratio operation is carried out by correcting delay time parameters of an air-fuel ratio operation of the upstream-side $O_2$ sensor with the output of the downstream-side $O_2$ sensor. That is, in a single $O_2$ sensor system, the switching of the output of the upstream-side $O_2$ sensor from the rich side to the lean side or vice versa is delayed for a definite time period thereby stabilizing the feedback control, but such a definite time period is variable in the above-mentioned double $O_2$ sensor system. In this double $O_2$ sensor system, although the downstream-side $O_2$ sensor has lower response speed characteristics when compared with the upstream-side $O_2$ sensor, the downstream-side $O_2$ sensor has an advantage in that the output fluctuation characteristics are small when compared with those of the upstream-side $O_2$ sensor, for the following reasons:

(1) On the downstream side of the catalyst converter, the temperature of the exhaust gas is low, so that the downstream-side $O_2$ sensor is not affected by a high temperature exhaust gas.

(2) On the downstream side of the catalyst converter, although various kinds of pollutants are trapped in the catalyst converter, these pollutants have little affect on the downstream-side $O_2$ sensor.

(3) On the downstream side of the catalyst converter, the exhaust gas is mixed so that the concentration of oxygen in the exhaust gas is approximately in the equilibrium state.

Therefore, according to the double $O_2$ sensor system, the fluctuation of the output of the upstreamside $O_2$ sensor is compensated for by a feedback control using the output of the downstream-side $O_2$ sensor. That is, even when the upstream-side $O_2$ sensor is deteriorated, the emissions such as HC, CO, and $NO_x$ can be minimized by the correction of the delay time parameters by the output of the downstream-side $O_2$ sensor. Actually, as illustrated in FIG. 1, in the worst case, the deterioration of the output characteristics of the $O_2$ sensor in a single $O_2$ sensor system directly effects a deterioration in the emission characteristics. On the other hand, in a double $O_2$ sensor system, even when the output characteristics of the upstream-side $O_2$ sensor are deteriorated, the emission characteristics are not deteriorated. That is, in a double $O_2$ sensor system, even if only the output characteristics of the downstream-side $O_2$ are stable, good emission characteristics are still obtained.

In the above-mentioned double $O_2$ sensor system, however, when the upstream-side $O_2$ sensor is deteriorated so that the controlled center thereof is shifted, one of the delay time parameters corrected by the downstream-side $O_2$ sensor is too large, thereby reducing the response speed (i.e., the control frequency), and thus reducing the accuracy of the feedback control. For example, as shown in FIG. 2A, when the upstream-side $O_2$ sensor, which generates an output voltage $V_1$, is only slightly deteriorated, a rich time parameter TDR, for which the switching of the output of the upstreamside $O_2$ sensor from the lean side to the rich side is delayed, is set at 32 ms, and a lean time parameter TDL, for which the switching of the output of the upstreamside $O_2$ sensor from the rich side to the lean side is delayed, is also set at 32 ms, so that the frequency of the feedback control is about 1.3 Hz. Contrary to this, when the upstream-side $O_2$ sensor is deteriorated, the rich time parameter TDR is set at 8 ms and the lean time parameter TDL is set at 256 ms, so that the frequency of the feedback control is about 0.93 Hz. This means that the response characteristics are reduced by about 30%, and surging may be generated. In FIGS. 2A and 2B, FAF designates an air-fuel ratio correction amount which will be explained later.

Note that, in order to avoid the reduction of the response speed, a maximum limit is imposed on the delay time parameters corrected by the output of the downstream-side $O_2$ sensor (see: FIG. 4 of Japanese Unexamined Patent Publication (Kokai) No. 58-72647). In this case, when one of the delay time parameters reaches such a maximum limit, the feedback control by the downstream-side $O_2$ sensor is substantially suspended, i.e., a double $O_2$ sensor system is suspended.

SUMMARY OF THE INVENTION

It is an object of the present invention to provide a double air-fuel ratio sensor ($O_2$ sensor) system in which the response characteristics of the entire system are not deteriorated even when the response characteristics of the upstream-side air-fuel ratio are deteriorated.

According to the present invention, in a double air-fuel sensor system including two air-fuel ratio sensor upstream and downstream of a catalyst converter provided in an exhaust gas passage, an air-fuel ratio correction amount is gradually changed in accordance with the output of the upstream-side air-fuel ratio sensor, and the actual air-fuel ratio is adjusted in accordance with the air-fuel ratio correction amount. The gradual-change speed of the air-fuel ratio correction amount is changed in accordance with the output of the downstream-side air-fuel ratio sensor. That is, integration amounts of the feedback control by upstream-side air-fuel ratio sensor are variable in accordance with the output of the downstream-side air-fuel ratio sensor. As a result, when the upstream-side air-fuel ratio sensor is deteriorated so that the controlled center thereof is shifted, one of the integration amounts is too large; however, in this case, the response speed (i.e., the control frequency) is little reduced.

BRIEF DESCRIPTION OF THE DRAWINGS

The present invention will be more clearly understood from the description as set forth below with reference to the accompanying drawings, wherein.

DESCRIPTION OF THE PREFERRED EMBODIMENTS

Figure 3:
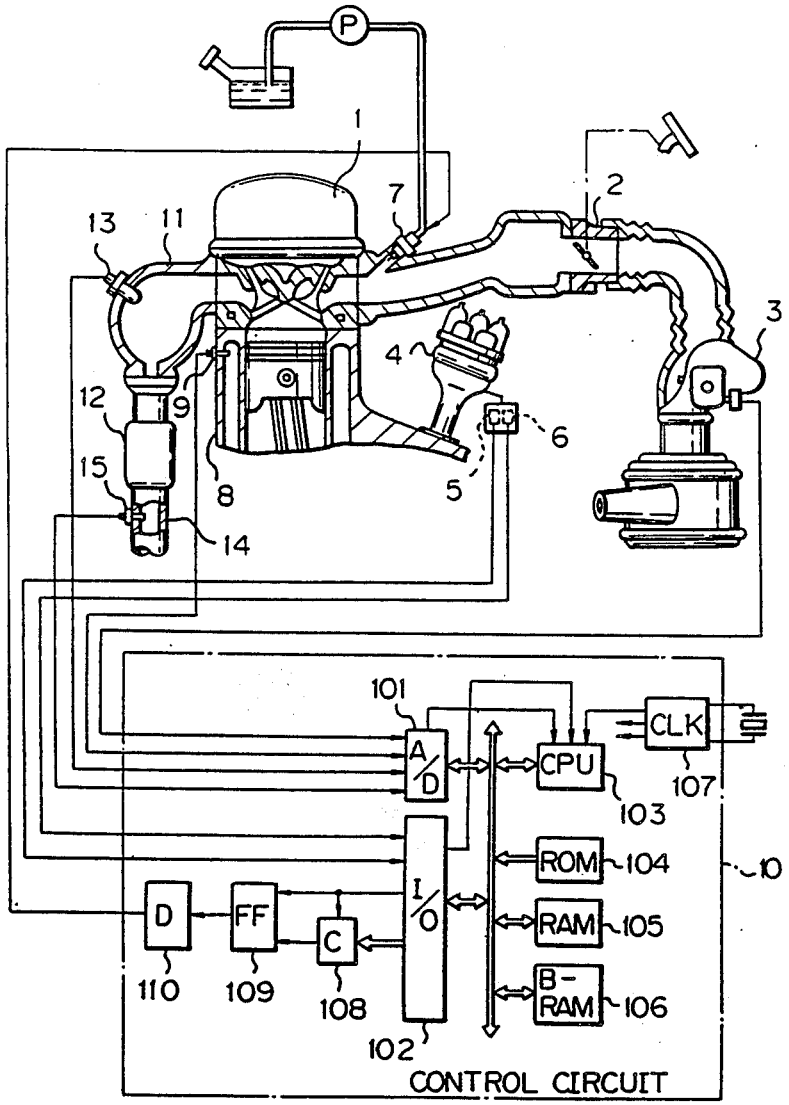
FIG. 3 is a schematic view of an internal combustion engine according to the present invention.

In FIG. 3, which illustrates an internal combustion engine according to the present invention, reference numeral 1 designates a four-cycle spark ignition engine disposed in an automotive vehicle. Provided in an air-intake passage 2 of the engine 1 is a potentiometer-type airflow meter 3 for detecting the amount of air taken into the engine 1, to generate an analog voltage signal in proportion to the amount of air flowing therethrough. The signal from the airflow meter 3 is transmitted to a multiplexer-incorporating analog-to-digital (A/D) converter 101 of a control circuit 10.

Disposed in a distributor 4 are crank angle sensors 5 and 6 for detecting the angle of the crankshaft (not shown) of the engine 1. In this case, the crank-angle sensor 5 generates a pulse signal at every 720° crank angle (CA) while the crank-angle sensor 6 generates a pulse signal at every 30° CA. The pulse signals of the crank angle sensors 5 and 6 supplied to an input/output (I/O) interface 102 of the control circuit 10. In addition, the pulse signal of the crank angle sensor 6 is then supplied to an interruption terminal of a central processing unit (CPU) 103.

Additionally provided in the air-intake passage 2 is a fuel injection valve 7 for supplying pressurized fuel from the fuel system to the air-intake port of the cylinder of the engine 1. In this case, other fuel injection valves are also provided for other cylinders, though not shown in FIG. 3.

Disposed in a cylinder block 8 of the engine 1 is a coolant temperature sensor 9 for detecting the temperature of the coolant. The coolant temperature sensor 9 generates an analog voltage signal in response to the temperature of the coolant and transmits it to the A/D converter 101 of the control circuit 10.

Provided in an exhaust system on the downstream-side of an exhaust manifold 11 is a three-way reducing and oxidizing catalyst converter 12 which removes three pollutants CO, HC, and $NO_x$ simultaneously from the exhaust gas.

Provided on the concentration portion of the exhaust manifold 11, i.e., upstream of the catalyst converter 12, is a first $O_2$ sensor 13 for detecting the concentration of oxygen composition in the exhaust gas. Further, provided in an exhaust pipe 14 downstream of the catalyst converter 12 is a second $O_2$ sensor 15 for detecting the concentration of oxygen composition in the exhaust gas. The $O_2$ sensors 13 and 15 generate output voltage signals and transmit them to the A/D converter 101 of the control circuit 10.

The control circuit 10, which may be constructed by a microcomputer, further comprises a central processing unit (CPU) 103, a ready-only memory (ROM) 104 for storing a main routine, interrupt routines such as a fuel injection routine, an ignition timing routine, tables (maps), constants, etc., a random access memory 105 (RAM) for storing temporary data, a backup RAM 106, a clock generator 107 for generating various clock signals, a down counter 108, a flip-flop 109, a driver circuit 110, and the like.

Note that the battery (not shown) is connected directly to the backup RAM 106 and, therefore, the content thereof is never erased even when the ignition switch (not shown) is turned off.

The down counter 108, the flip-flop 109, and the driver circuit 110 are used for controlling the fuel injection valve 7. That is, when a fuel injection amount TAU is calculated in a TAU routine, which will be later explained, the amount TAU is preset in the down counter 108, and simultaneously, the flip-flop 109 is set. As a result, the driver circuit 110 initiates the activation of the fuel injection valve 7. On the other hand, the down counter 108 counts up the clock signal from the clock generator 107, and finally generates a logic "1" signal from the carry-out terminal thereof, to reset the flip-flop 109, so that the driver circuit 110 stops the activation of the fuel injection valve 14. Thus, the amount of fuel corresponding to the fuel injection amount TAU is injected into the fuel injection valve 7.

Interruptions occur at the CPU 103, when the A/D converter 101 completes an A/D conversion and generates an interrupt signal; when the crank angle sensor 6 generates a pulse signal; and when the clock generator 109 generates a special clock signal.

The intake air amount data Q of the airflow meter 3 and the coolant temperature data THW are fetched by an A/D conversion routine(s) executed at every predetermined time period and are then stored in the RAM 105. That is, the data Q and THW in the RAM 105 are renewed at every predetermined time period. The engine speed NE is calculated by an interrupt routine executed at 30° CA, i.e., at every pulse signal of the crank angle sensor 6, and is then stored in the RAM 105.

Figure 1:
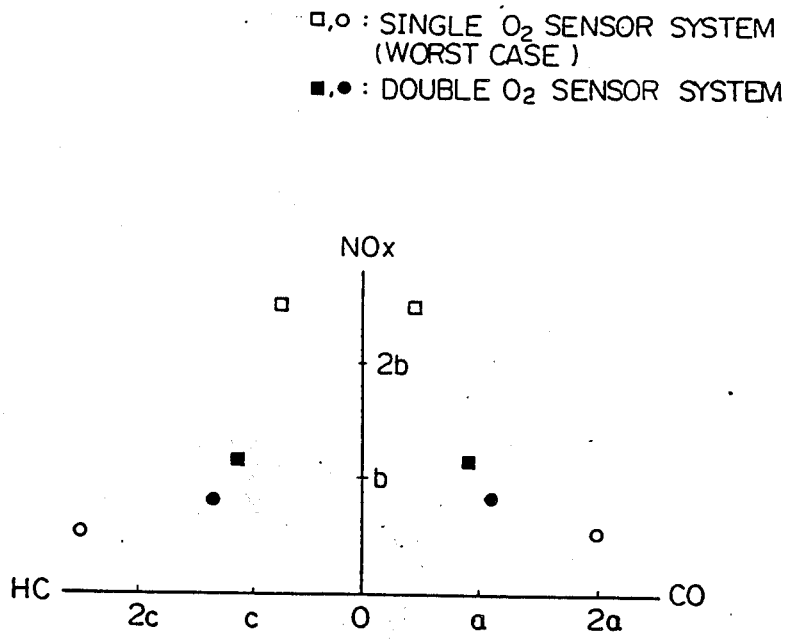
FIG. 1 is a gragh showing the emission characteristics of a single $O_2$ sensor system and a double $O_2$ sensor system.
Figure 2A:
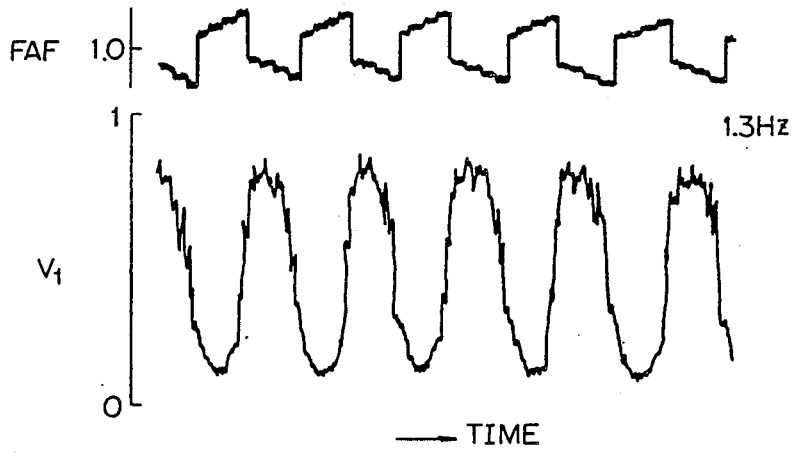
Fig. 2A PRIOR ART
FIGS. 2A and 2B are timing diagrams showing the output characteristics of the upstream-side $O_2$ sensor.
Figure 2B:
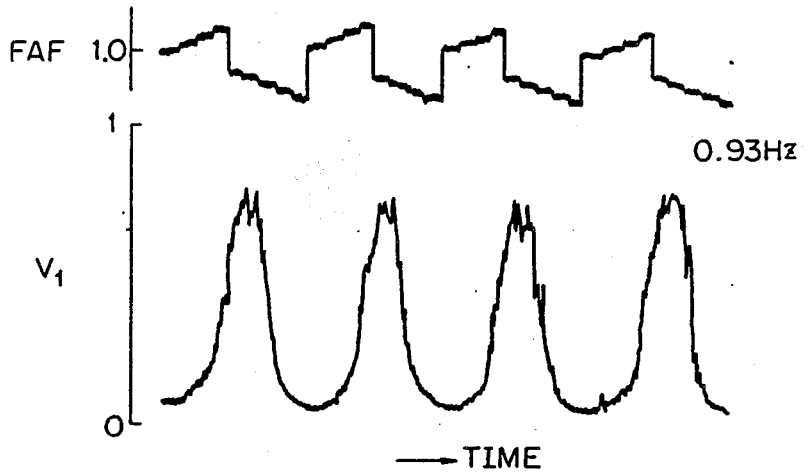
Fig. 2B PRIOR ART

The operation of the control circuit 10 of FIG. 2 will be explained with reference to the flow charts of FIGS. 4, 6, 7, and 8.

Figures 4, 4A:
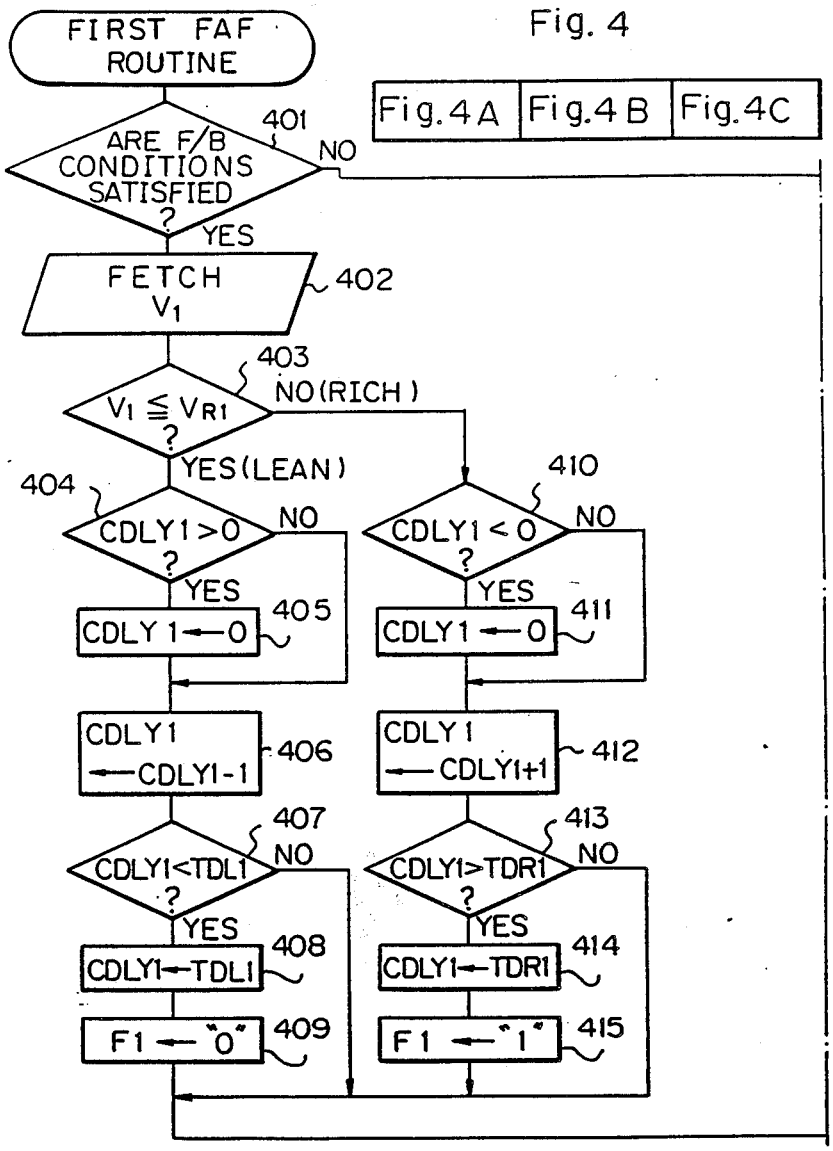
FIGS. 4, 4A, 4B, 4C, 6, 6A, 6B, 7, 7A, 7B, and 8 are flow charts showing the operation of the control circuit of FIG. 3.
Figure 4B:
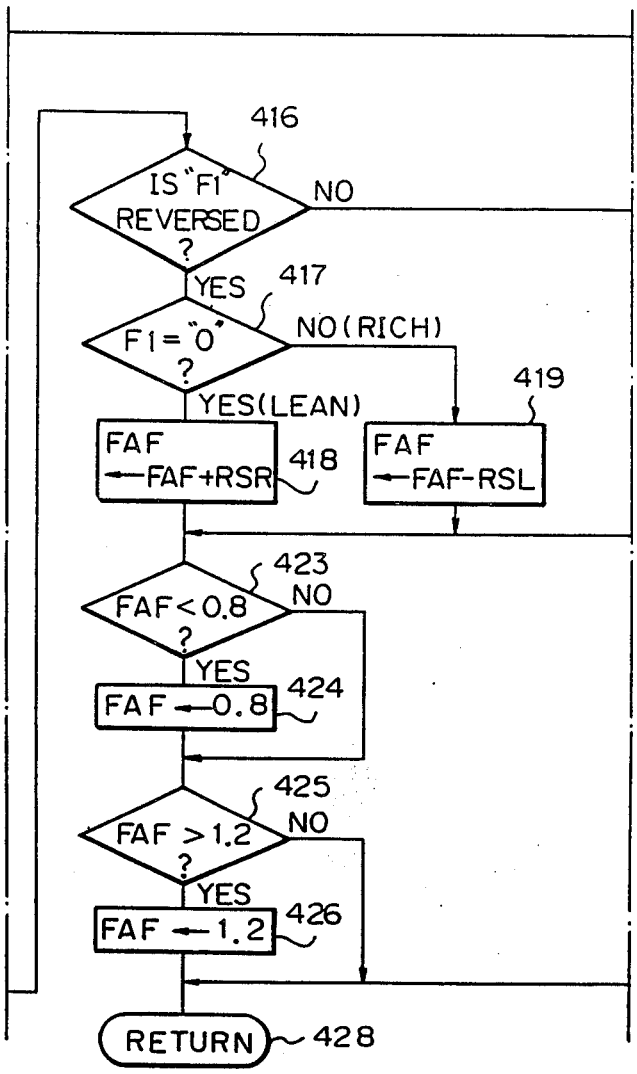
Figure 4C:
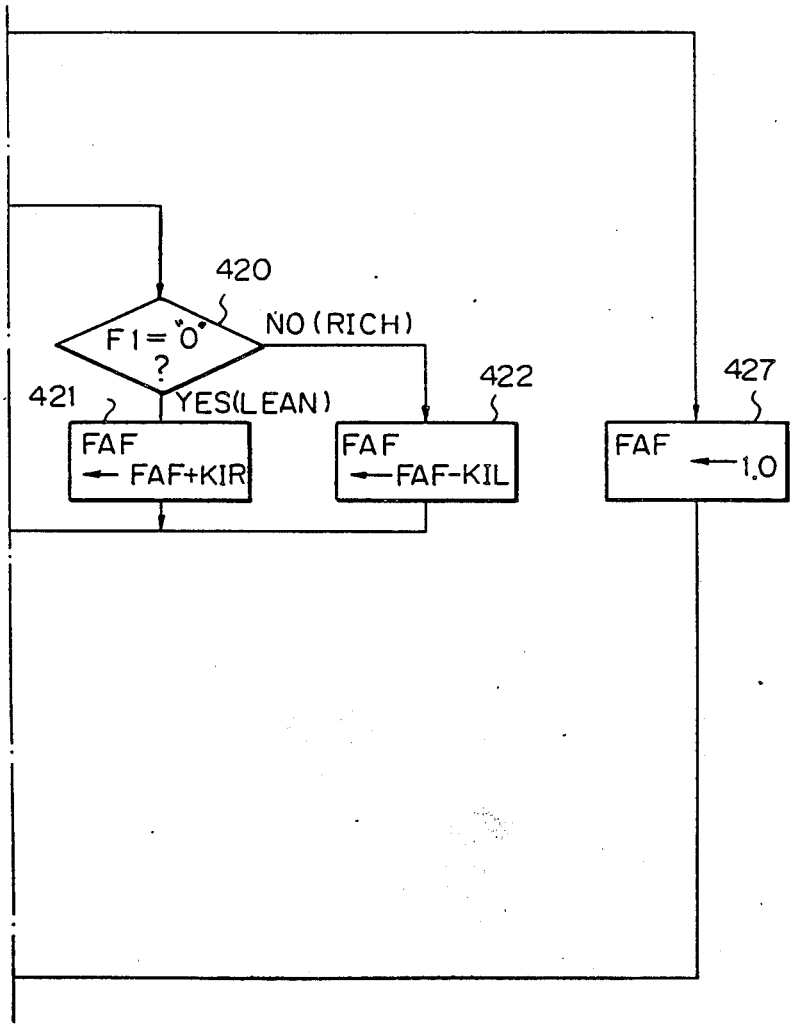

FIG. 4 is a routine for calculating a first air-fuel ratio feedback correction amount FAF in accordance with the output of the upstream-side $O_2$ sensor 13 executed at every predetermined time period such as 50 ms.

At step 401, it is determined whether or not all the feedback control (closed-loop control) conditions by the upstream-side $O_2$ sensor 13 are satisfied. The feedback control conditions are as follows:

(i) the engine is not in a starting state;

(ii) the coolant temperature THW is higher than 50° C.;

(iii) the power fuel incremental amount FPOWER is 0; and (iv) the upstream-side $O_2$ sensor 13 is not in an activated state.

Note that the determination of activation/non-activation of the upstream-side $O_2$ sensor 13 is carried out by determining whether or not the coolant temperature THW≧70° C., or by whether or not the output of the upstream-side $O_2$ sensor 13 is once swung, i.e., once changed from the rich side to the lean side or vice versa. Of course, other feedback control conditions are introduced as occasion demands. However, an explanation of such other feedback control conditions is omitted.

If one or more of the feedback control conditions is not satisfied, the control proceeds to step 427, in which the amount FAF is caused to be 1.0 (FAF=1.0), thereby carrying out an open-loop control operation. Note that, in this case, the correction amount FAF can be a learning value or a value immediately before the feedback control by the upstream $O_2$ sensor 13 is stopped.

Contrary to the above, at step 401, if all of the feedback control conditions are satisfied, the control proceeds to step 402.

At step 402, an A/D conversion is performed upon the output voltage $V_1$ of the upstream-side $O_2$ sensor 13, and the A/D converted value thereof is then fetched from the A/D converter 101. Then, at step 403, the voltage $V_1$ is compared with a reference voltage $V_{R1}$ such as 0.45 V, thereby determining whether the current air-fuel ratio detected by the upstream-side $O_2$ sensor 13 is on the rich side or on the lean side with respect to the stoichiometric air-fuel ratio.

If $V_1 \leqq V_{R1}$, which means that the current air-fuel ratio is lean, the control proceeds to step 404, which determines whether or not the value of a first delay counter CDLY1 is positive. If CDLY1>0, the control proceeds to step 405, which clears the first delay counter CDLY1, and then proceeds to step 406. If CDLY1≦0, the control proceeds directly to step 406. At step 406, the first delay counter CDLY1 is counted down by 1, and at step 407, it is determined whether or not CDLY1<TDL1. Note that TDL1 is a lean delay time period for which a rich state is maintained even after the output of the upstream-side $O_2$ sensor 13 is changed from the rich side to the lean side, and is defined by a negative value. Therefore, at step 407, only when CDLY1<TDL1 does the control proceed to step 408, which causes CDLY1 to be TDL1, and then to step 409, which causes a first air-fuel ratio flag F1 to be "0" (lean state). On the other hand, if $V_1 > V_{R1}$, which means that the current air-fuel ratio is rich, the control proceeds to step 410, which determines whether or not the value of the first delay counter CDLY1 is negative. If CDLY1<0, the control proceeds to step 411, which clears the first delay counter CDLY1, and then proceeds to step 412. If CDLY1≧0, the control directly proceeds to 412. At step 412, the first delay counter CDLY1 is counted up by 1, and at step 413, it is determined whether or not CDLY1>TDR1. Note that TDR1 is a rich delay time period for which a lean state is maintained even after the output of the upstream-side $O_2$ sensor 13 is changed from the lean side to the rich side, and is defined by a positive value. Therefore, at step 413, only when CDLY1>TDR1 does the control proceed to step 414, which causes CDLY1 to be TDR1, and then to step 415, which causes the first air-fuel ratio flag F1 to be "1" (rich state).

Next, at step 416, it is determined whether or not the first air-fuel ratio flag F1 is reversed, i.e., whether or not the delayed air-fuel ratio detected by the upstream-side $O_2$ sensor 13 is reversed. If the first air-fuel ratio flag F1 is reversed, the control proceeds to steps 417 to 419, which carry out a skip operation. That is, if the flag F1 is "0" (lean) at step 417, the control proceeds to step 418, which remarkably increases the correction amount FAF by a skip amount RSR. Also, if the flag F1 is "1" (rich) at step 417, the control proceeds to step 419, which remarkably decreases the correction amount FAF by the skip amount RS1. On the other hand, if the first air-fuel ratio flag F1 is not reversed at step 416, the control proceeds to steps 420 to 422, which carries out an integration operation. That is, if the flag F1 is "0" (lean) at step 420, the control proceeds to step 421, which gradually increases the correction amount FAF by a rich integration amount KIR. Also, if the flag F1 is "1" (rich) at step 420, the control proceeds to step 422, which gradually decreases the correction amount FAF by a lean integration amount KIL.

The correction amount FAF is guarded by a minimum value 0.8 at steps 423 and 424, and by a maximum value 1.2 at steps 425 and 426, thereby also preventing the controlled air-fuel ratio from becoming overrich or overlean.

The correction amount FAF is then stored in the RAM 105, thus completing this routine of FIG. 4 at step 428.

Figures 5A, 5B, 5C, 5D:
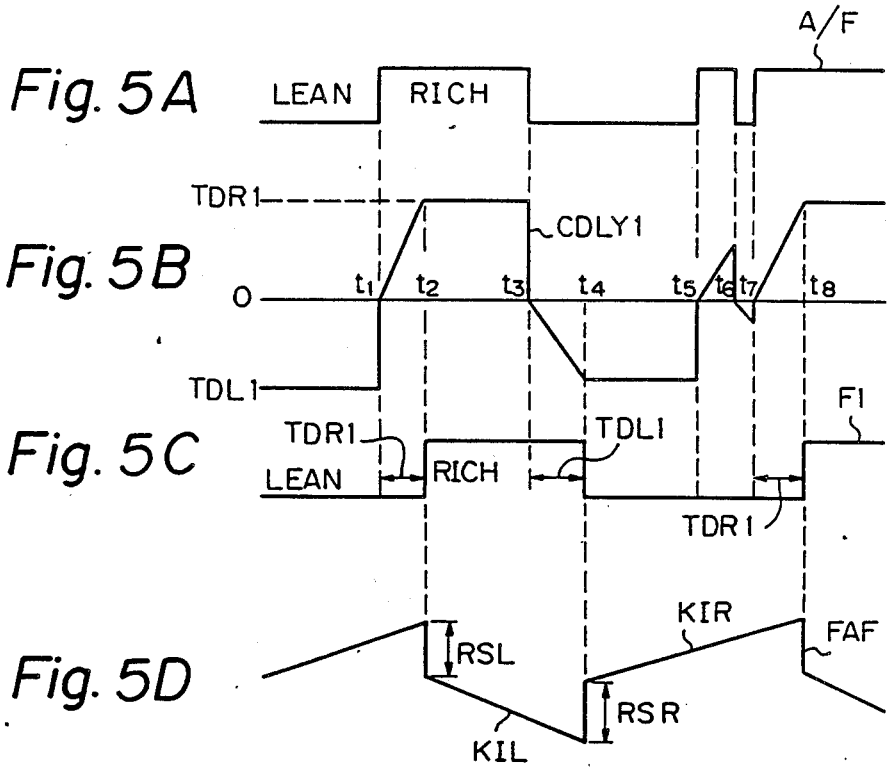
FIGS. 5A through 5D are timing diagrams explaining the flow chart of FIG. 4.

The operation by the flow chart of FIG. 4 will be further explained with reference to FIGS. 5A through 5D. As illustrated in FIG. 5A, when the air-fuel ratio A/F is obtained by the output of the upstream-side $O_2$ sensor 13, the first delay counter CDLY1 is counted up during a rich state, and is counted down during a lean state, as illustrated in FIG. 5B. As a result, a delayed air-fuel ratio corresponding to the first air-fuel ratio flag F1 is obtained as illustrated in FIG. 5C. For example, at time $t_1$, even when the air-fuel ratio A/F is changed from the lean side to the rich side, the delayed air-fuel ratio F1 is changed at time $t_2$ after the rich delay time period TDR1. Similarly, at time $t_3$, even when the air-fuel ratio A/F is changed from the rich side to the lean side, the delayed air-fuel ratio F1 is changed at time $t_4$ after the lean delay time period TDL1. However, at time $t_5$, $t_6$, or $t_7$, when the air-fuel ratio A/F is reversed within a smaller time period than the rich delay time period TDR1 or the lean delay time period TDL1, the delayed air-fuel ratio F1 is reversed at time $t_8$. That is, the delayed air-fuel ratio F1 is stable when compared with the air-fuel ratio A/F. Further, as illustrated in FIG. 5D, at every change of the delayed air-fuel ratio F1 from the rich side to the lean side, or vice versa, the correction amount FAF is shipped by the skip amount RSR or RSL, and also, the correction amount FAF is gradually increased or decreased in accordance with the delayed air-fuel ratio F1.

For example, if the rich delay time period becomes larger than the lean delay time period (TDR1>(−TDL1)), the controlled air-fuel ratio becomes richer, and if the lean delay time period becomes larger than the rich delay time period ((−TDL1)>(TDR1)), the controlled air-fuel ratio becomes leaner. Thus, the air-fuel ratio can be controlled by changing the rich delay time period TDR1 and the lean delay time period TDL1 in accordance with the output of the downstream-side $O_2$ sensor 15. In this case, however, when either the rich delay time period TDR1 or the lean delay time period TDL1 is too large, the response speed (i.e., the control frequency) is reduced, as explained before. Therefore, in the present invention, the rich delay time TDR1 and the lean delay time TDL1 are definite, for example, TDR1=12 (corresponding to 48 ms)

TDL1=−6 (corresponding to 24 ms).

The reason why the rich delay time period TDR1 is larger than the lean delay time period −TDL1 is that there is a difference in output characteristics and deterioration speed between the upstream-side $O_2$ sensor 13 and the downstream-side $O_2$ sensor 15.

In the present invention, an additional control for the controlled air-fuel ratio by the upstream-side $O_2$ sensor 13 is carried out by changing the integration amounts KIR and KIL in accordance with the output of the downstream-side $O_2$ sensor 15. For example, if the rich integration amount KIR is increased or if the lean integration amount KIL is decreased, the controlled air-fuel ratio becomes richer, and if the lean integration amount KIL is increased or if the rich integration amount KIR is decreased, the controlled air-fuel ratio becomes leaner. Thus, the air-fuel ratio can be controlled by changing the rich integration amount KIR and the lean integration amount KIL in accordance with the output of the downstream-side $O_2$ sensor 15.

Figures 6, 6A:
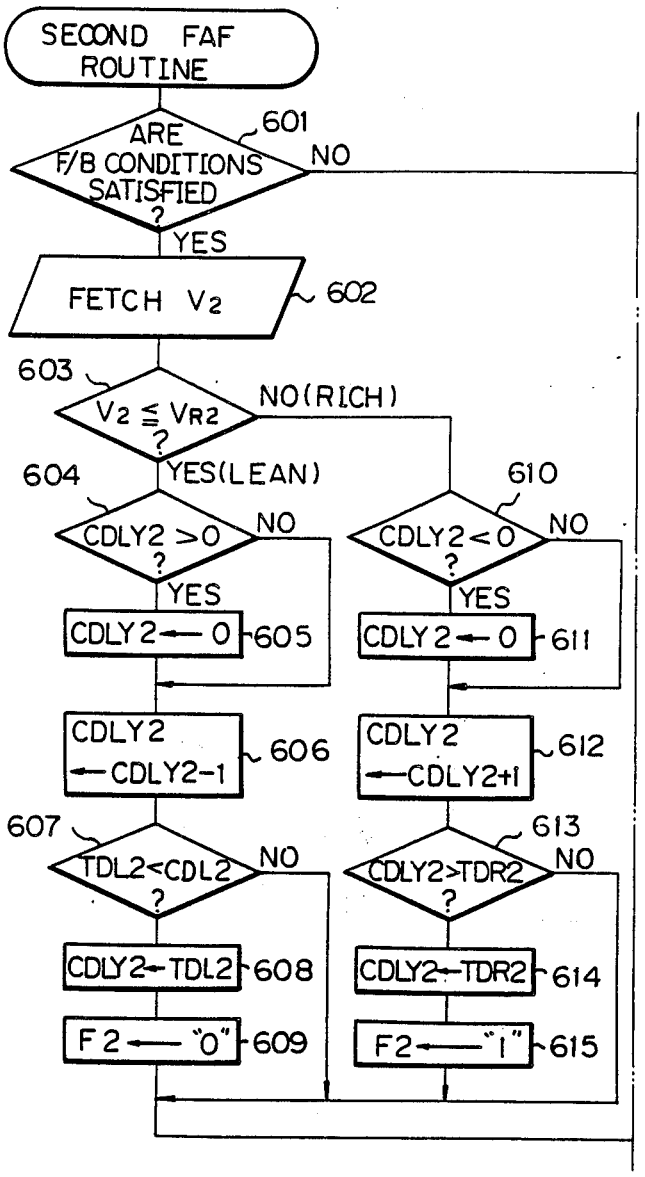
Figure 6B:
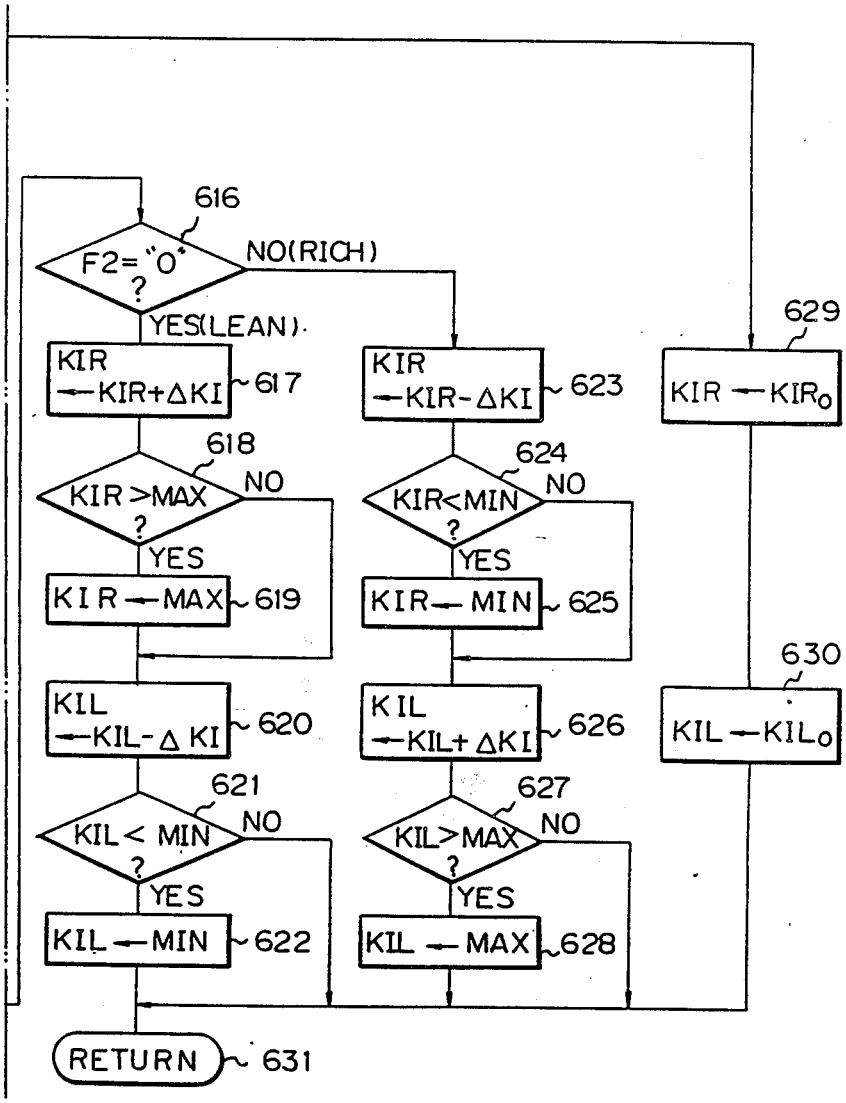

FIG. 6 is a routine for calculating the integration amounts KIR and KIL in accordance with the output of the downstream-side $O_2$ sensor 15 executed at every predetermined time period such as 1 s.

At step 601, it is determined whether or not all the feedback control (closed-loop control) conditions by the downstream-side $O_2$ sensor 15 are satisfied. The feedback control conditions are as follows:

(i) the engine is not in a starting state;

(ii) the coolant temperature THW is higher than 50° C.;

(iii) the power fuel incremental amount FPOWER is 0; and (iv) the downstream-side $O_2$ sensor 15 is not in an activated state.

Note that the determination of activation/non-activation of the downstream-side $O_2$ sensor 15 is carried out by determining whether or not the coolant temperature THW≧70° C., or by whether or not the output of the downstream-side $O_2$ sensor 15 is once swung, i.e., is once changed from the rich side to the lean side or vice versa. Of course, other feedback control conditions are introduced as occasion demands. However, an explanation of such other feedback control conditions is omitted.

If one or more of the feedback control conditions is not satisfied, the control proceeds to step 629 in which the rich integration amount KIR is caused to be a definite value $KIR_0$ such as 5%/s, and also proceeds to step 630 in which the lean integration amount KIL is caused to be a definite value $KIL_0$ such as 5%/s, thereby carrying out an open-loop control for the downstream-side $O_2$ sensor 15. Note that, also in this case, the values KIR and KIL can be learning values or values immediately before the feedback control by the downstream-side $O_2$ sensor 15 is stopped.

Contrary to the above, at step 601, if all of the feedback control conditions are satisfied, the control proceeds to step 602.

At step 602, an A/D conversion is performed upon the output voltage $V_2$ of the downstream-side $O_2$ sensor 15, and the A/D converted value thereof is then fetched from the A/D converter 101. Then, at step 603, the voltage $V_2$ is compared with a reference voltage $V_{R2}$ such as 0.55 V, thereby determining whether the current air-fuel ratio detected by the downstream-side $O_2$ sensor 15 is on the rich side or on the lean side with respect to the stoichiometric air-fuel ratio. Note that the reference voltage $V_{R2}$ (=0.55 V) is preferably higher than the reference voltage $V_{R1}$ (=0.45 V), in consideration of the difference in output characteristics and deterioration speed between the $O_2$ sensor 13 upstream of the catalyst converter 12 and the $O_2$ sensor 15 downstream of the catalyst converter 12.

Steps 604 through 615 correspond to steps 404 through 415, respectively, thereby performing a delay operation upon the determination at step 603. Here, a rich delay time period is defined by TDR2, and a lean delay time period is defined by TDL2. As a result of the delayed determination, if the air-fuel ratio is rich, a second air-fuel ratio flag F2 is caused to be "1", and if the air-fuel ratio is lean, the second air-fuel ratio flag F2 is caused to be "0".

At step 616, it is determined whether or not the second air-fuel ratio F2 is "0". If F2="0", which means that the air-fuel ratio is lean, the control proceeds to steps 617 through 622, and if F2="1", which means that the air-fuel ratio is rich, the control proceeds to steps 623 through 628.

At step 617, the rich integration amount KIR is increased by ΔKI to move the air-fuel ratio to the rich side. At steps 618 and 619, the rich integration amount KIR is guarded by a maximum value MAX. Further, at step 620, the lean integration amount KIL, is decreased by ΔKI to move the air-fuel ratio to the rich side. At steps 621 and 622, the lean integration amount KIL is guarded by a minimum value MIN.

On the other hand, at step 623, the rich integration amount KIR is decreased by ΔKI to move the air-fuel ratio to the lean side. At steps 624 and 625, the rich integration amount KIR is guarded by the minimum value MIN. Further, at step 626, the lean integration amount KIL is increased by ΔKI to move the air-fuel ratio to the lean side. At steps 627 and 628, the lean integration amount KIL is guarded by the maximum value MAX.

The integration amounts KIR and KIL are then stored in the RAM 105, thereby completing this routine of FIG. 6 at step 631.

Thus, according to the routine of FIG. 6, when the delayed output of the downstream-side $O_2$ sensor 15 is lean, the rich integration amount KIR is gradually increased, and the lean integration amount KIL gradually decreased, thereby moving the air-fuel ratio to the rich side. Contrary to this, when the delayed output of the downstream-side $O_2$ sensor 15 is rich, the rich integration amount KIR is gradually decreased, and the lean integration amount KIL is gradually increased, thereby moving the air-fuel ratio to the lean side.

In FIG. 6, the minimum value MIN is a level such as 3%/s by which the transient characteristics of the integration operation using the amounts KIR and KIL can be maintained, and the maximum value MAX is a level such as 10%/s by which the drivability is not deteriorated by the fluctuation of the air-fuel ratio.

In FIG. 6, it is also possible that only the rich integration amount KIR is variable while the lean integration amount KIL is fixed at $KIL_0$, and similarly, it is also possible that only the lean integration amount KIL is variable while the rich integration amount KIR is fixed at $KIR_0$.

Figures 7, 7A:
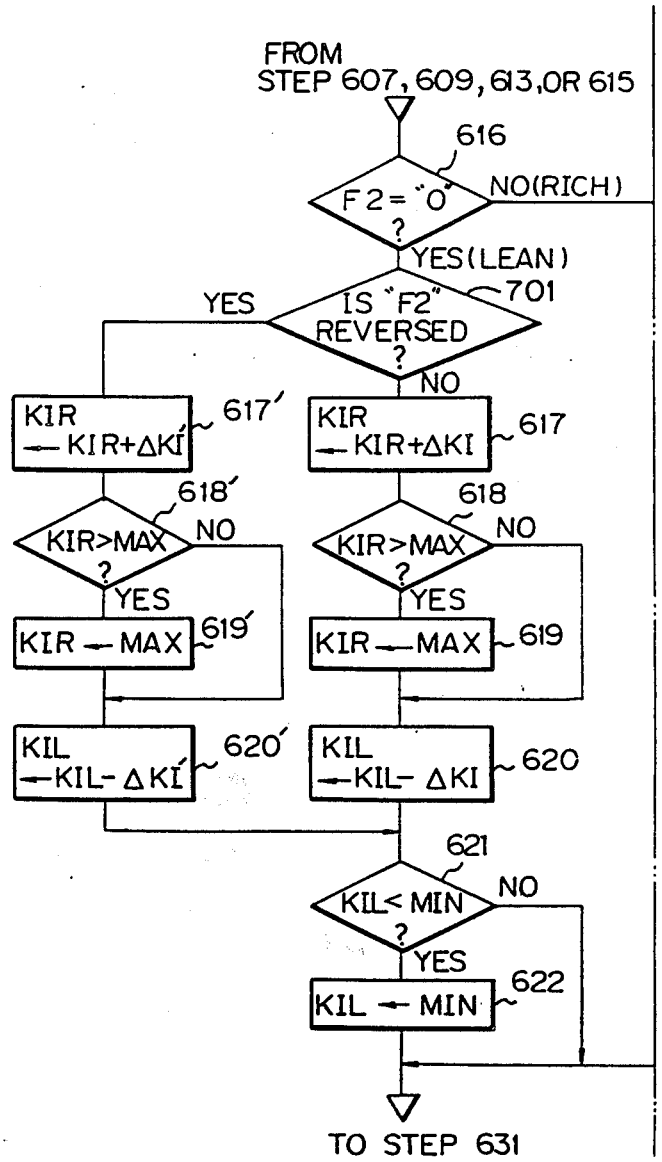
Figure 7B:
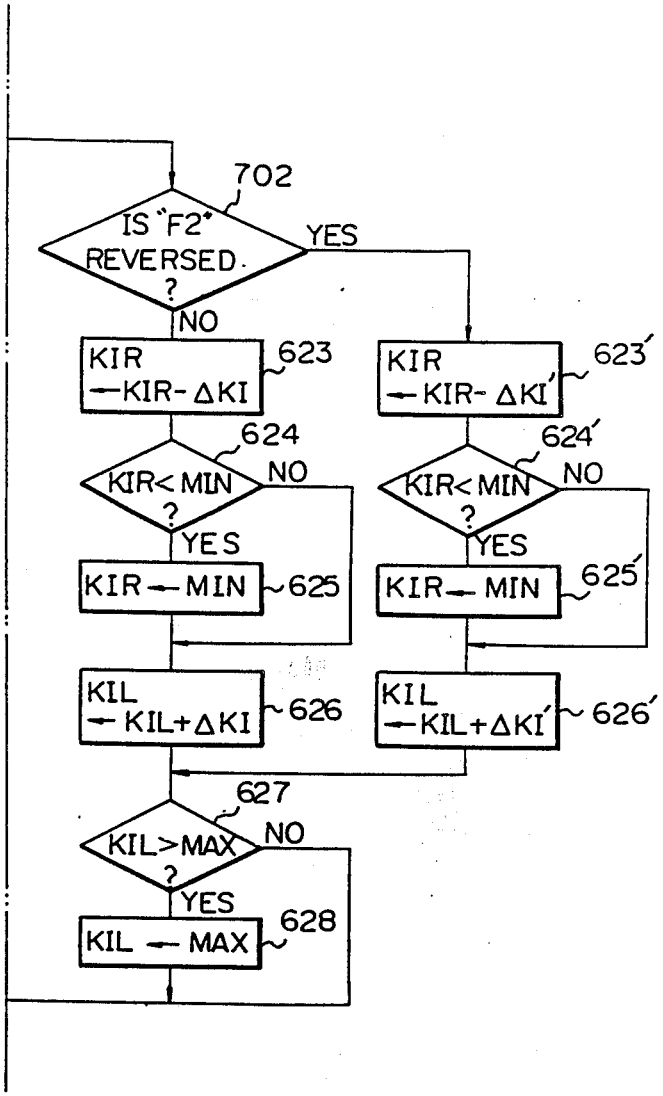

In FIG. 7, which is a partial modification of FIG. 6, steps 617' through 620', 623' through 626', 701, and 702 are added. That is, at step 616, when the second air-fuel ratio flag F2 is "0" (lean), the control proceeds to step 701, which determines whether or not the second air-fuel ratio flag F2 is reversed. Only if the second air-fuel ratio flag F2 is reversed, does the control proceed to steps 617' to 620', which perform skip operations upon the integration amounts KIR and KIL. That is, at step 617', the rich integration amount KIR is remarkably increased by $\Delta KI'$ ($>\Delta KI$), and at steps 618' and 619', the rich integration amount KIR is guarded by the maximum value MAX. Further, at step 620', the lean integration amount KIL is remarkably decreased by $\Delta KI'$, and then at step 621, the lean integration amount KIL is guarded by the minimum value MIN.

Similarly, at step 616, when the second air-fuel ratio flag F2 is "1" (rich), the control proceeds to step 702, which determines whether or not the second air-fuel ratio flag F2 is reversed. Only if the second air-fuel ratio flag F2 is reversed, does the control proceed to steps 623' to 626', which perform skip operations upon the integration amounts KIR and KIL. That is, at step 623', the rich integration amount KIR is remarkably decreased by $\Delta KI'$ and at steps 624' and 625', the rich integration amount KIR is guarded by the minimum value MIN. Further, at step 626', the lean integration amount KIL is remarkably increased by $\Delta KI'$, and then at step 621, the lean integration amount KIL is guarded by the maximum value MAX.

Thus, according to the modification of FIG. 7, when the delayed air-fuel ratio detected by the downstream-side $O_2$ sensor 15 is reversed, skip operations are performed upon the integration amounts KIR and KIL, thereby further improving the transient characteristics of the integration operation using the amounts KIR and KIL.

Further, in FIG. 7, it is also possible that only the rich integration amount KIR is variable while the lean integration amount KIL is fixed at $KIL_0$, and similarly, it is also possible that only the lean integration amount KIL is variable while the rich integration amount KIR is fixed at $KIR_0$.

In FIGS. 4 and 6 (or 7), note than the calculated amounts FAF, KIR, and KIL can be stored on the backup RAM 106, thereby improving the drivability at a restarting timing of the engine.

Figure 8:
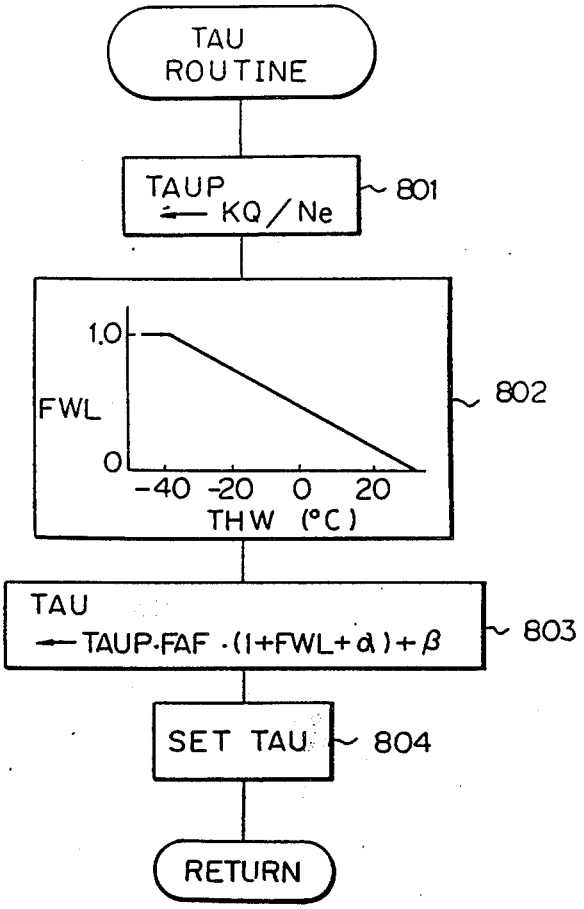

FIG. 8 is a routine for calculating a fuel injection amount TAU executed at every predetermined crank angle such as 360° CA. At step 801, a base fuel injection amount TAUP is calculated by using the intake air amount data Q and the engine speed data Ne stored in the RAM 105. That is, $$TAUP \leftarrow KQ/Ne$$

where K is a constant. Then at step 802, a warming-up incremental amount FWL is calculated from a one-dimensional map by using the coolant temperature data THW stored in the RAM 105. Note that the warming-up incremental amount FWL decreases when the coolant temperature THW increases. At step 803, a final fuel injection amount TAU is calculated by $$TAU \leftarrow TAUP \cdot FAF \cdot (1+FWL+\alpha)+\beta$$

where $\alpha$ and $\beta$ are correction factors determined by other parameters such as the voltage of the battery and the temperature of the intake air. At step 804, the final fuel injection amount TAU is set in the down counter 108, and in addition, the flip-flop 109 is set to initiate the activation of the fuel injection valve 7. Then, this routine is completed by step 805. Note that, as explained above, when a time period corresponding to the amount TAU has passed, the flip-flop 109 is reset by the carry-out signal of the down counter 108 to stop the activation of the fuel injection valve 7.

Figures 9A, 9B, 9C, 9D, 9E, 9F, 9G, 9H, 9I:
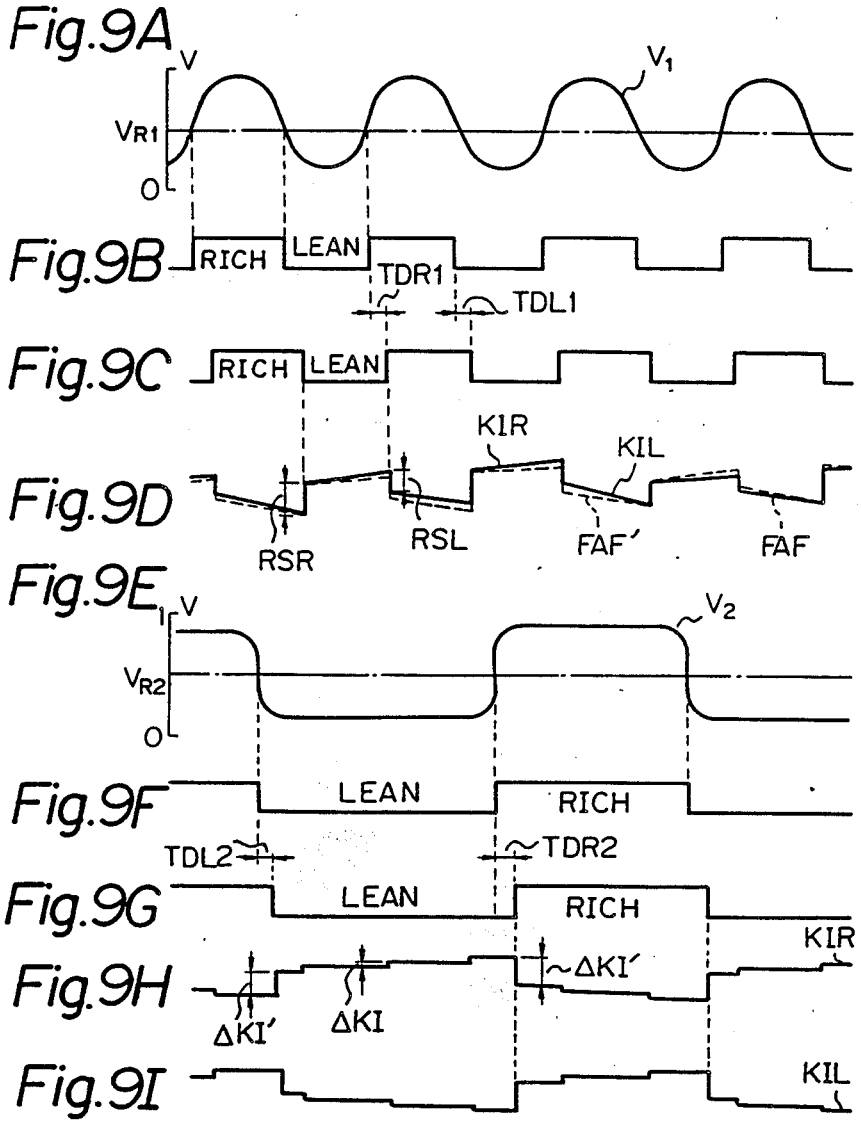
FIGS. 9A through 9I are timing diagrams explaining the flow charts of FIGS. 4, 6(7), and 8.

FIGS. 9A through 9I are timing diagrams for explaining the air-fuel ratio correction amount FAF and the integration amounts KIR and KIL obtained by the flow charts of FIGS. 4, 6(7), and 8. When the output $V_1$ of the upstream-side $O_2$ sensor 13 is changed as illustrated in FIG. 9A, the determination at step 403 of FIG. 4 is shown in FIG. 9B, and a delayed determination thereof corresponding to the first air-fuel ratio flag F1 is shown in FIG. 9C. As a result, as shown in FIG. 9D, every time the delayed determination is changed from the rich side to the lean side, or vice versa, the air-fuel ratio correction amount FAF is skipped by the skip amount RSR or RSL. On the other hand, when the output $V_2$ of the second $O_2$ sensor 15 is changed as illustrated in FIG. 9E, the determination at step 603 of FIG. 6 is shown in FIG. 9F, and the delayed determination thereof corresponding to the second air-fuel ratio flag F2 is shown in FIG. 9G. As a result, as shown in FIGS. 9H and 9I, every time the delayed determination is changed from the rich side to the lean side, or vice versa, the rich integration amount KIR and the lean integration amount KIL are skipped by $\Delta KI'$, and also, the rich integration amount KIR and the lean integration amount KIL are gradually increased or decreased in accordance with the delayed output of the downstream-side $O_2$ sensor 15. Note that in FIG. 9D, the solid line indicated by FAF obtained by the routines 4, 7, and 8, is helpful in improving the transient characteristics of the controlled air-fuel ratio, as compared with the dotted line indicated by FAF' obtained by the routines 4, 6, and 8.

Figure 10:
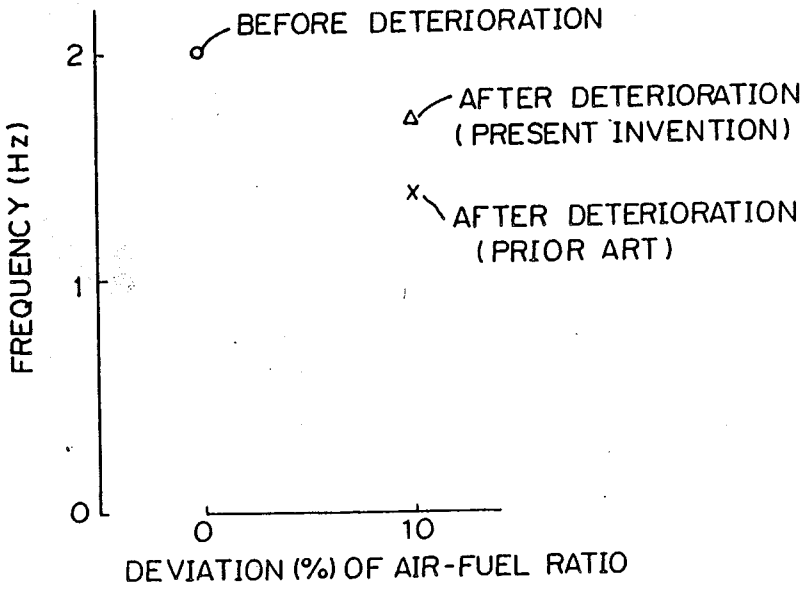
FIG. 10 is a graph showing the effect of the present invention.

Thus, the controlled center of the air-fuel ratio correction amount FAF is variable by changing the integration amounts KIR and KIL in accordance with the output of the downstream-side $O_2$ sensor 15. For example, as shown in FIG. 10, it is assumed that, when the upstream-side $O_2$ sensor 13 is not deteriorated so that no deviation of the controlled value of the air-fuel ratio is generated, the control frequency of the air-fuel ratio (i.e., the air-fuel ratio correction amount FAF) is about 2 Hz. In this state, if the upstream-side $O_2$ sensor 13 is deteriorated so that the controlled center of the air-fuel ratio is deviated by 10%, the control frequency is made to be about 1.3 Hz by compensating for the deviation of the controlled air-fuel ratio using the correction method of the delay time parameters TDR1 and TDL1 in accordance with the output of the downstream-side $O_2$ sensor 15. Contrary to this, the control frequency is made to be about 1.8 Hz by compensating for the deviation of the controlled air-fuel ratio using the correction method of the integration amounts KIR and KIL in accordance with the output of th downstream-side $O_2$ sensor 15.

Also, the first air-fuel ratio feedback control by the upstream-side $O_2$ sensor 13 is carried out at every relatively small time period, such as 4 ms, and the second air-fuel ratio feedback control by the downstream-side $O_2$ sensor 15 is carried out at every relatively large time period, such as 1 s. This is because the upstream-side $O_2$ sensor 13 has good response characteristics when compared with the downstream-side $O_2$ sensor 15.

Still further, a Karman vortex sensor, a heat-wire type flow sensor, and the like can be used instead of the airflow meter.

Although in the above-mentioned embodiments, a fuel injection amount is calculated on the basis of the intake air amount and the engine speed, it can be also calculated on the basis of the intake air pressure and the engine speed, or the throttle opening and the engine speed.

Further, the present invention can be also applied to a carburetor type internal combustion engine in which the air-fuel ratio is controlled by an electric air control value (EACV) for adjusting the intake air amount; by an electric bleed air control valve for adjusting the air bleed amount supplied to a main passage and a slow passage; or by adjusting the secondary air amount introduced into the exhaust system. In this case, the base fuel injection amount corresponding to TAUP at step 801 of FIG. 8 is determined by the carburetor itself, i.e., the intake air negative pressure and the engine speed, and the air amount corresponding to TAU at step 803 of FIG. 8.

Further, a CO sensor, a lean-mixture sensor or the like can be also used instead of the $O_2$ sensor.

As explained above, the functions of a double air-fuel ratio sensor system according to the present invention can be fulfilled without reducing the response speed, i.e., the control frequency.

We claim:

1. A method for controlling the air-fuel ratio in an internal combustion engine having a catalyst converter for removing pollutants in the exhaust gas thereof, and upstream-side and downstream-side air-fuel ratio sensors disposed upstream and downstream, respectively, of said catalyst converter for detecting the concentration of a specific component in the exhaust gas, comprising the steps of:

comparing the output of said upstream-side air-fuel ratio sensor with a first predetermined value;

gradually changing an air-fuel ratio correction amount in accordance with the comparison result of the output of said upstream-side air-fuel ratio sensor with said first predetermined value;

comparing the output of said downstream-side air-fuel ratio with a second predetermined value;

changing the gradual-change speed of said air-fuel ratio correction amount in said gradually-changing step in accordance with the comparison result of said downstream-side air-fuel ratio sensor with said second predetermined value; and adjusting the actual air-fuel ratio in accordance with said air-fuel ratio correction amount, wherein said gradual-change speed changing step comprises the steps of:

gradually decreasing the increasing speed of said air-fuel ratio correction amount when the output of said downstream-side air-fuel ratio sensor is on the rich side with respect to said first predetermined value; and gradually increasing the increasing speed of said air-fuel ratio correction amount, when the output of said downstream-side air-fuel ratio sensor is on the lean side with respect to said second predetermined value.

2. A method as set forth in claim 1, wherein said gradual-change speed changing step further comprises the steps of:

remarkably decreasing the increasing speed of said air-fuel ratio correction amount when the comparison result of said downstream-side air-fuel ratio sensor is switched from the lean side to the rich side with respect to said second predetermined value; and remarkably increasing the increasing speed of said air-fuel ratio correction amount when the comparison result of said downstream-side air-fuel ratio sensor is switched from the rich side to the lean side with respect to said second predetermined value.

3. A method as set forth in claim 1, further comprising a step of remarkably changing said air-fuel ratio correction amount when the comparison result of said upstream-side air-fuel ratio sensor is switched from the lean side to the rich side or vice versa.

4. A method for controlling the air-fuel ratio in an internal combustion engine having a catalyst converter for removing pollutants in the exhaust gas thereof, and upstream-side and downstream-side air-fuel ratio sensors disposed upstream and downstream, respectively, of said catalyst converter for detecting the concentration of a specific component in the exhaust gas, comprising the steps of:

comparing the output of said upstream-side air-fuel ratio sensor with a first predetermined value;

gradually changing an air-fuel ratio correction amount in accordance with the comparison result of the output of said upstream-side air-fuel ratio sensor with said first predetermined value;

comparing the output of said downstream-side air-fuel ratio with a second predetermined value;

changing the gradual-change speed of said air-fuel ratio correction amount in said gradually-changing step in accordance with the comparison result of said downstream-side air-fuel ratio sensor with said second predetermined value; and adjusting the actual air-fuel ratio in accordance with said air-fuel ratio correction amount, wherein said gradual-change speed changing step comprises the steps of:

gradually increasing the decreasing speed of said air-fuel ratio correction amount when the output of said downstream-side air-fuel ratio sensor is on the rich side with respect to said first predetermined value; and gradually decreasing the decreasing speed of said air-fuel ratio correction amount, when the output of said downstream-side air-fuel ratio sensor is on the lean side with respect to said second predetermined value.

5. A method as set forth in claim 4, wherein said gradual-change speed changing step further comprises the steps of:

remarkably increasing the decreasing speed of said air-fuel ratio correction amount when the comparison result of said downstream-side air-fuel ratio sensor is switched from the lean side to the rich side with respect to said second predetermined value; and remarkably decreasing the decreasing speed of said air-fuel ratio correction amount when the comparison result of said downstream-side air-fuel ratio sensor is switched from the rich side to the lean side with respect to said second predetermined value.

6. A method as set forth in claim 4, wherein said gradual-change speed changing step further comprises the steps of:

gradually decreasing the increasing speed of said air-fuel ratio correction amount when the output of said downstream-side air-fuel ratio sensor is on the rich side with respect to said first predetermined value; and gradually increasing the increasing speed of said air-fuel ratio correction amount, when the output of said downstream-side air-fuel ratio sensor is on the lean side with respect to said second predetermined value.

7. A method as set forth in claim 6, wherein said gradual-change speed changing step further comprises the steps of:

remarkably decreasing the increasing speed of said air-fuel ratio correction amount when the comparison result of said downstream-side air-fuel ratio sensor is switched from the lean side to the rich side with respect to said second predetermined value; and remarkably increasing the increasing speed of said air-fuel ratio correction amount when the comparison result of said downstream-side air-fuel ratio sensor is switched from the rich side to the lean side with respect to said second predetermined value.

8. An apparatus for controlling the air-fuel ratio in an internal combustion engine having a catalyst converter for removing pollutants in the exhaust gas thereof, and upstream-side and downstream-side air-fuel ratio sensors disposed upstream and downstream, respectively, of said catalyst converter for detecting the concentration of a specific component in the exhaust gas, comprising the steps of:

means for comparing the output of said upstream-side air-fuel ratio sensor with a first predetermined value;

means for gradually changing an air-fuel ratio correction amount in accordance with the comparison result of the output of said upstream-side air-fuel ratio sensor with said first predetermined value;

means for comparing the output of said downstream-side air-fuel ratio with a second predetermined value;

means for changing the gradual-change speed of said air-fuel ratio correction amount in said gradually-changing step in accordance with the comparison result of said downstream-side air-fuel ratio sensor with said second predetermined value; and means for adjusting the actual air-fuel ratio in accordance with said air-fuel ratio correction amount, wherein said gradual-change speed changing means comprises:

means for gradually decreasing the increasing speed of said air-fuel ratio correction amount when the output of said downstream-side air-fuel ratio sensor is on the rich side with respect to said first predetermined value; and means for gradually increasing the increasing speed of said air-fuel ratio correction amount when the output of said downstream-side air-fuel ratio sensor is on the lean side with respect to said second predetermined value.

9. An apparatus as set forth in claim 8, wherein said gradual-change speed changing means further comprises:

means for remarkably decreasing the increasing speed of said air-fuel ratio correction amount when the comparison result of said downstream-side air-fuel ratio sensor is switched form the lean side to the rich side with respect to said second predetermined value; and means for remarkably increasing the increasing speed of said air-fuel ratio correction amount when the comparison result of said downstream-side air-fuel ratio sensor is switched from the rich side to the lean side with respect to said second predetermined value.

10. An apparatus as set forth in claim 8, further comprising means for remarkably changing said an air-fuel ratio correction amount when the comparison result of said upstream-side air-fuel ratio sensor is switched from the lean side to the rich side or vice versa.

11. An apparatus for controlling the air-fuel ratio to an internal combustion engine having a catalyst converter for removing pollutants in the exhaust gas thereof, and upstream-side and downstream-side air-fuel ratio sensors disposed upstream and downstream, respectively, of said catalyst converter for detecting the concentration of a specific component in the exhaust gas, comprising the steps of:

means for comparing the output of said upstream-side air-fuel ratio sensor with a first predetermined value;

means for gradually changing an air-fuel ratio correction amount in accordance with the comparison result of the output of said upstream-side air-fuel ratio sensor with said first predetermined value;

means for comparing the output of said downstream-side air-fuel ratio with a second predetermined value;

means for changing the gradual-change speed of said air-fuel ratio correction amount in said gradually-changing step in accordance with the comparison result of said downstream-side air-fuel ratio sensor with said second predetermined value; and means for adjusting the actual air-fuel ratio in accordance with said air-fuel ratio correction amount, wherein said gradual-change speed changing means comprises:

means for gradually increasing the decreasing speed of said air-fuel ratio correction amount when the output of said downstream-side air-fuel ratio sensor is on the rich side with respect to said first predetermined value; and means for gradually decreasing the decreasing speed of said air-fuel ratio correction amount when the output of said downstream-side air-fuel ratio sensor is on the lean side with respect to said second predetermined value.

12. An apparatus as set forth in claim 11, wherein said gradual-change speed changing means further comprises:

means for remarkably increasing the decreasing speed of said air-fuel ratio correction amount when the comparison result of said downstream-side air-fuel ratio sensor is switched from the lean side to the rich side with respect to said second predetermined value; and means for remarkably decreasing the decreasing speed of said air-fuel ratio correction amount when the comparison result of said downstream-side air-fuel ratio sensor is switched from the rich side to the lean side with respect to said second predetermined value.

13. An apparatus as set forth in claim 11, wherein said gradual-change speed changing means further comprises:

means for gradually decreasing the increasing speed of said air-fuel ratio correction amount when the output of said downstream-side air-fuel ratio sensor is on the rich side with respect to said first predetermined value; and means for gradually increasing the increasing speed of said air-fuel ratio correction amount, when the output of said downstream-side air-fuel ratio sensor is on the lean side with respect to said second predetermined value.

14. An apparatus as set forth in claim 13, wherein said gradual-change speed changing means further comprises:

means for remarkably decreasing the increasing speed of said air-fuel ratio correction amount when the comparison result of said downstream-side air-fuel ratio sensor is switched from the lean side to the rich side with respect to said second predetermined value; and means for remarkably increasing the increasing speed of said air-fuel ratio correction amount when the comparison result of said downstream-side air-fuel ratio sensor is switched from the rich side to the lean side with respect to said second predetermined value.

* * * * *